US009656772B2

(12) United States Patent
Brozell et al.

(10) Patent No.: US 9,656,772 B2
(45) Date of Patent: May 23, 2017

(54) CONTAINER WITH POUR SPOUT

(71) Applicant: Owens-Brockway Glass Container Inc., Perrysburg, OH (US)

(72) Inventors: Brian J Brozell, Maumee, OH (US); Edward A Grant, Toledo, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 0 days.

(21) Appl. No.: 13/875,006

(22) Filed: May 1, 2013

(65) Prior Publication Data

US 2014/0166606 A1 Jun. 19, 2014

Related U.S. Application Data

(63) Continuation-in-part of application No. 13/284,520, filed on Oct. 28, 2011.

(51) Int. Cl.

| | |
|---|---|
| ***B65D 1/02*** | (2006.01) |
| ***B65B 7/28*** | (2006.01) |
| ***B65D 23/06*** | (2006.01) |
| ***B65D 23/10*** | (2006.01) |
| ***B65D 41/04*** | (2006.01) |

(52) U.S. Cl.

CPC ..... *B65B 7/2835* (2013.01); *B65D 1/023* (2013.01); *B65D 23/06* (2013.01); *B65D 23/102* (2013.01); *B65D 41/0442* (2013.01); *B65D 2203/00* (2013.01); *B65D 2501/009* (2013.01)

(58) Field of Classification Search

CPC ..... A47G 19/2205; B65D 23/06; B65D 2543/00092; B65D 2543/00296; B44D 3/128

USPC .... 222/560, 572, 575, 44, 571, 567; 215/44, 215/43, 41, 384, 398, 45

See application file for complete search history.

(56) References Cited

U.S. PATENT DOCUMENTS

| | | | | | |
|---|---|---|---|---|---|
| 491,198 | A | * | 2/1893 | Straus | B65D 1/023 215/40 |
| 1,108,023 | A | | 8/1914 | Texter | |
| 1,421,696 | A | * | 7/1922 | Kucera | 222/572 |
| 1,814,659 | A | | 7/1931 | Barroll | |
| 2,039,345 | A | | 5/1936 | Ravenscroft | |
| 2,057,745 | A | * | 10/1936 | Scheyer et al. | 222/567 |
| 2,059,910 | A | | 11/1936 | Ravenscroft | |
| 2,075,776 | A | | 3/1937 | Barnby | |
| RE20,427 | E | | 6/1937 | Geerlings | |

(Continued)

FOREIGN PATENT DOCUMENTS

| | | |
|---|---|---|
| WO | WO 2004065249 | 8/2004 |
| WO | 2008040671 | 4/2008 |

(Continued)

OTHER PUBLICATIONS

PCT Search Report and Written Opinion, Int. Serial No. PCT/US2014/033483, Int. Filing Date: Apr. 9, 2014, Applicant: Owens-Brockway Glass Container Inc., Mail Date: Jul. 9, 2014.

*Primary Examiner* — Charles P Cheyney

(57) ABSTRACT

A container includes a neck finish extending from a body and having at least two thickened wall portions circumferentially spaced apart and extending radially inwardly, and including interior surfaces disposed radially inwardly of a neck finish interior surface to at least partially establish an internal trough, and axially facing shoulders axially recessed with respect to a sealing lip of the neck finish.

25 Claims, 13 Drawing Sheets

(56) References Cited

U.S. PATENT DOCUMENTS

| | | | | | |
|---|---|---|---|---|---|
| 2,135,330 | A | | 11/1938 | Desser | |
| 2,688,823 | A | | 9/1954 | Weber | |
| 3,022,916 | A | | 2/1962 | Spooner | |
| 3,235,111 | A | | 2/1966 | Whitton, Jr. et al. | |
| 3,247,994 | A | * | 4/1966 | Stocklund et al. | 215/321 |
| 3,738,524 | A | | 6/1973 | Richie | |
| 3,885,696 | A | * | 5/1975 | Eberhardt | 215/337 |
| 4,630,761 | A | * | 12/1986 | Thomson | 222/551 |
| 4,649,068 | A | * | 3/1987 | Collette | B29C 45/26 215/42 |
| 4,674,644 | A | * | 6/1987 | Jacobs | 215/320 |
| 4,732,289 | A | * | 3/1988 | Granat et al. | 215/252 |
| 5,566,861 | A | * | 10/1996 | Serano | 222/109 |
| 5,947,309 | A | * | 9/1999 | Anderson | 215/44 |
| 5,964,383 | A | | 10/1999 | Cargile | |
| 6,059,153 | A | * | 5/2000 | Olson et al. | 222/465.1 |
| 6,085,949 | A | | 7/2000 | Zimny et al. | |
| 6,648,157 | B2 | * | 11/2003 | Shai et al. | 215/42 |
| 7,770,745 | B2 | | 8/2010 | Weissmann et al. | |
| 7,976,767 | B2 | * | 7/2011 | Ungrady | B29B 11/14 215/40 |
| 9,051,078 | B2 | * | 6/2015 | Martini et al. | |
| 2007/0235477 | A1 | | 10/2007 | Penny et al. | |
| 2008/0230573 | A1 | | 9/2008 | Enahoro | |
| 2010/0181278 | A1 | | 7/2010 | Martin | |

FOREIGN PATENT DOCUMENTS

| | | |
|---|---|---|
| WO | 2013062671 | 5/2013 |
| WO | 2014092931 | 6/2014 |

* cited by examiner

CONTAINER WITH POUR SPOUT

The present disclosure is directed to containers and, more particularly, to a container with a pour spout.

BACKGROUND AND SUMMARY OF THE DISCLOSURE

Containers often include a body and a neck finish extending axially from the body to accept a closure. The body usually includes a base, a sidewall extending axially away from the base, and a shoulder between the sidewall and the neck finish. The neck finish typically includes circumferentially extending threads or lugs to cooperate with corresponding features of the closure. U.S. patents that illustrate glass containers of this type include U.S. Pat. No. 2,688,823 and U.S. Pat. No. 3,738,524.

A general object of the present disclosure, in accordance with one aspect of the disclosure, is to provide a container having a pour spout to direct flow of product through the pour spout and out of the container.

The present disclosure embodies a number of aspects that can be implemented separately from or in combination with each other.

A container in accordance with one aspect of the disclosure includes a body including a base and a sidewall extending from the base, and a neck finish extending from the body and including a neck finish interior surface facing radially inwardly and including one or more circular portions, and a sealing lip facing generally axially and fully circumferentially continuously around the neck finish interior surface. The container also includes at least two thickened wall portions circumferentially spaced apart and extending radially inwardly, and including interior surfaces disposed radially inwardly of the neck finish interior surface to at least partially establish an internal trough, and axially facing shoulders axially recessed with respect to the lip of the neck finish.

In accordance with an additional aspect of the disclosure, there is provided a package that includes a container including a neck finish having a neck finish sealing lip to establish a circular planar sealing surface, and spout walls disposed radially inwardly with respect to the sealing lip, and having axially facing shoulders axially recessed with respect to the sealing lip. The package also includes a closure coupled to the container, and including a lid having a base wall and a peripheral skirt extending axially from the base wall, and a seal carried by the lid, wherein an axial clearance exists between the lid base wall and the axially facing shoulders of the spout walls.

In accordance with an additional aspect of the disclosure, there is provided a container that includes a neck finish having an outer surface, one or more closure engagement features on the outer surface, a semi-circular rear wall having a rear interior surface, and a semi-circular trough wall disposed on an opposite side from the rear wall and coaxial with the rear wall and having a trough interior surface. The neck finish also includes a neck finish sealing lip to establish a circular planar sealing surface, and spout walls disposed radially inwardly with respect to the sealing lip and laterally opposed from one another on either side of the trough wall, distal with respect to the rear wall, and having radial wall thicknesses greater than that of the rear and trough walls and having axially facing shoulders axially recessed with respect to the sealing lip.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
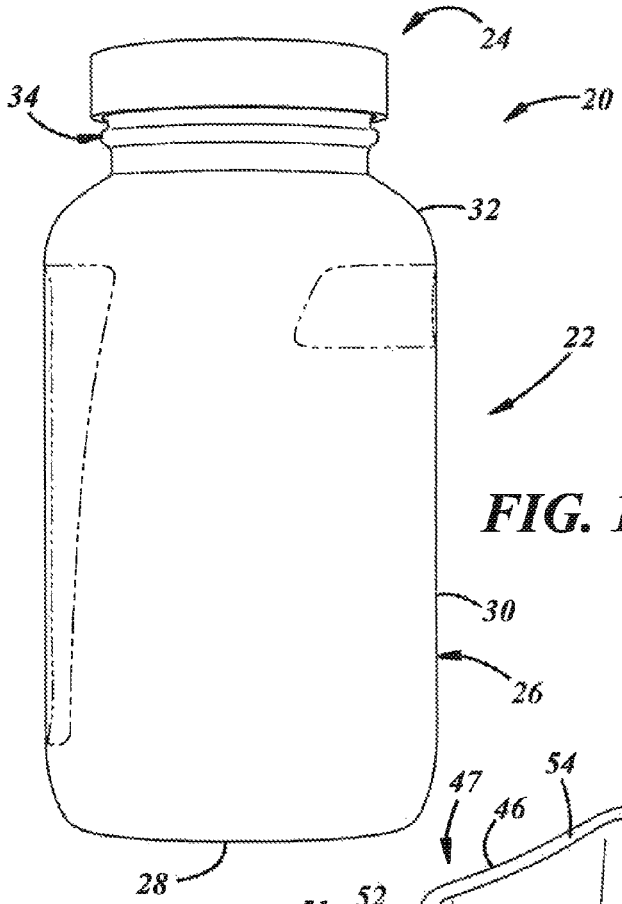
FIG. 1 is an elevational view of a package including a container and a closure in accordance with an illustrative embodiment of the present disclosure.

FIG. 1 illustrates a package 20 including a container 22, and a closure 24 that is coupled to the container 22. The package 20 may be used to package pickles, baby food, salsa, peppers, spaghetti sauces, jams, or any other food products. The package 20 also may be used to package other types of products including but not limited to liquids, gels, powders, particles, and the like.

The container 22 may be composed of glass, or any other material suitable for containing food products. The container 22 may be provided in any suitable sizes, and may be a wide mouth type of container. The container 22 includes a body 26 including a base 28, and a sidewall 30 extending in a direction axially away from the base 28. The body 26 also may include a shoulder 32 extending from the sidewall 30, as illustrated in the Figures. In other embodiments, however, the container body 26 need not include a shoulder. As used herein, directional words such as top, bottom, upper, lower, radial, circumferential, lateral, longitudinal, transverse, vertical, horizontal, and the like are employed by way of description and not limitation.

Figure 2:
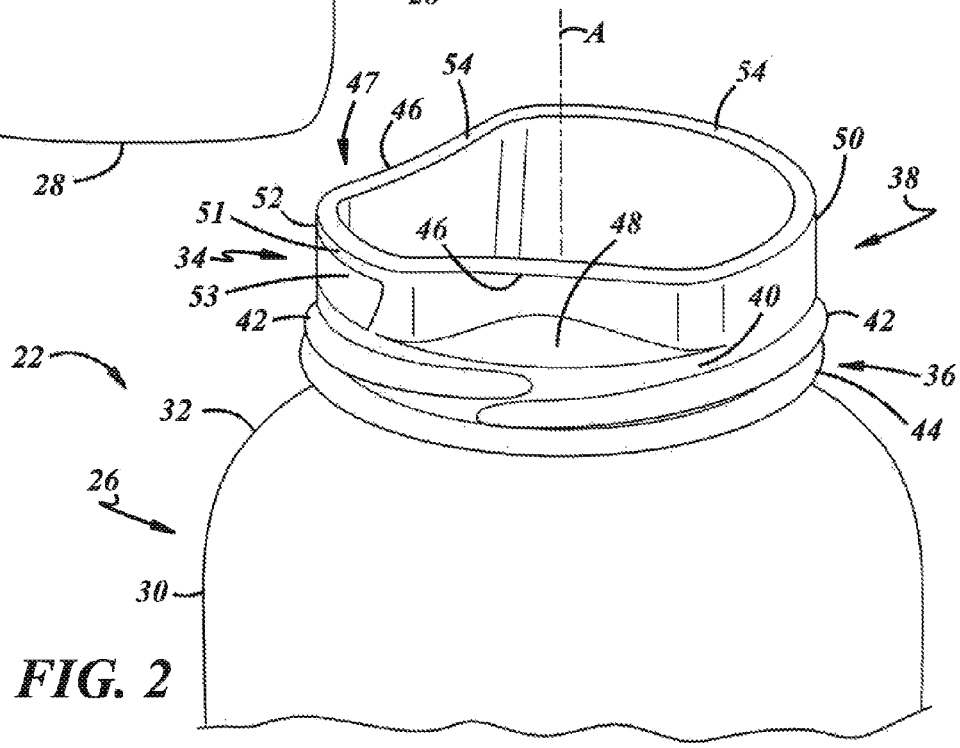
FIG. 2 is an enlarged fragmentary perspective view of the container of FIG. 1.
Figure 3:
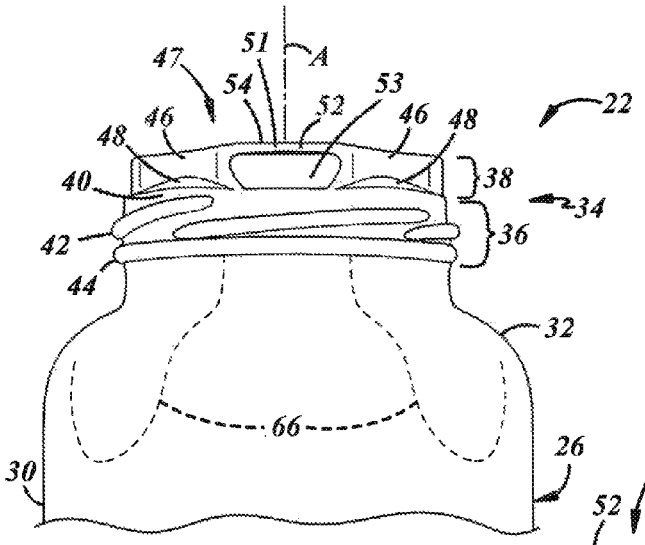
FIG. 3 is an enlarged fragmentary front view of the container of FIG. 1.
Figure 4:
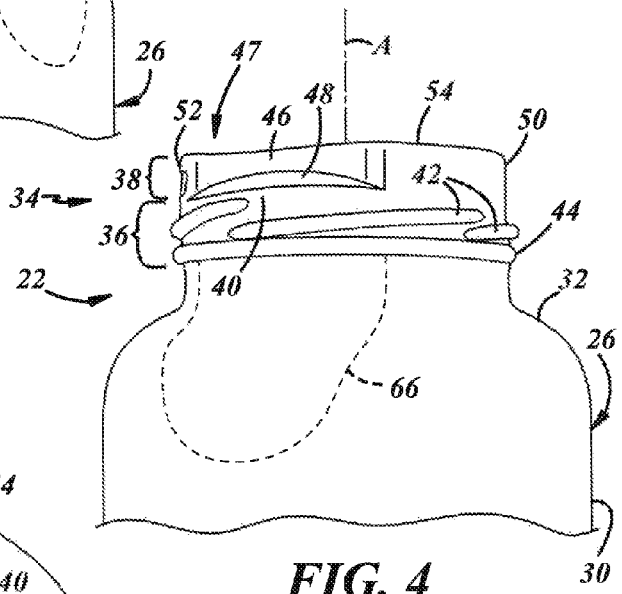
FIG. 4 is an enlarged fragmentary side view of the container of FIG. 1.

Referring to FIGS. 2 through 4, the container 22 also has a first, longitudinal axis A, and includes a neck finish 34 extending from the body 26. More particularly, the neck finish 34 may extend from the shoulder 32 of the sidewall 30. In other embodiments, however, where the container body 26 does not include a shoulder, the neck finish 34 may extend directly from the sidewall 30. The neck finish 34 includes a lower portion 36 and an upper portion 38 remote from the body 26 and extending from the lower portion 36. The lower portion 36 may be cylindrical, and the upper portion 38 may be non-cylindrical.

The lower portion 36 may extend completely circumferentially around the neck finish 34, and has an outer surface 40 and one or more closure engagement features that may include lugs, bayonets, thread segments 42, or any other suitable features, on the outer surface 40. As used herein, the term thread segment includes whole, partial, multiple, and/or an interrupted thread and/or thread segment. The thread segments 42 may include two, three, four, or any suitable quantity of thread segments 42. In any case, the thread segments 42 may extend completely circumferentially around the neck finish 34. The lower portion 36 also may include a capping flange 44 extending completely circumferentially around the neck finish 34 and disposed axially between the thread segments 42 and the body shoulder 32.

Figure 5:
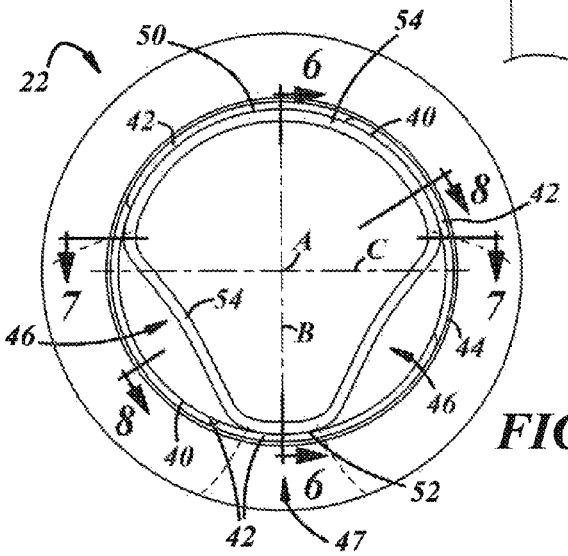
FIG. 5 is an enlarged top view of the container of FIG. 1.

The upper portion 38 includes indents or spout walls 46 disposed radially inwardly with respect to the lower portion 36 and laterally opposed from one another on either side of a second, radial axis B (FIG. 5). The upper portion 38 also may include shoulders or ledges 48 disposed between the spout walls 46 and the outer surface 40 of the lower portion 36. As used herein the term "ledge" generally includes a portion extending transversely to the axis A and adjacent to the higher, more prominent, spout walls 46.

The upper portion 38 also may include a rear wall 50 extending between the spout walls 46 at rear ends of the spout walls 46. The rear wall 50 may be semi-circular or semi-cylindrical in shape and may be an extension of a corresponding portion of the lower portion 36 of the neck finish 34.

The upper portion 38 further may include a trough wall 52 extending circumferentially between the spout walls 46 at forward ends of the spout walls 46, and disposed on an opposite side of a third, transverse radial axis C from the rear wall 50. The trough wall 52 also may be semi-circular or semi-cylindrical in shape and may extend axially from a corresponding part of the lower portion 36 of the neck finish 34. The trough wall 52 may include a lip or projection 51 and a recessed portion 53, for example, to aid in pouring contents from the container 22 in a clean or anti-drip manner. The projection 51 may extend from the sealing surface 54 in an axial direction toward the thread segments 42. The recessed portion 53 may be disposed axially between the projection 51 and the thread segment(s) 42, and the recessed portion 53 may disposed radially inward of a radially outermost portion of the projection 51. For example, a radially outer surface of the projection 51 may have the same radial dimension as a corresponding radially outer surface of the rear wall 50, whereas a radially outer surface of the recessed portion 53 may have a radial dimension that is smaller than the radially outer surfaces of the projection 51 and/or the rear wall 50.

In other embodiments, the rear and trough walls 50, 52 may be of any other suitable shapes. Also, the spout walls 46 alone or together with other portions of the container 22 (e.g. the trough wall 52) may form a pour spout 47.

The walls 46, 50, 52 of the upper portion 38 of the neck finish 34 may terminate in a planar sealing surface 54. At least for the reason that the spout walls 46 may be disposed radially inwardly of the rear wall 50, the planar sealing surface 54 may be non-circular. In particular, the spout walls 46 may be incurvate with respect to the first axis A. Also, the upper portion 38 may be clamshell-shaped when viewed from above the upper portion 38 along the axis A.

One or more of the thread segments 42 may be disposed in a circumferential overlapping relationship with the spout walls 46, the rear wall 50, and the trough wall 52. Accordingly, the securement of the closure 24 may be symmetrical, and uninterrupted or continuous, around the container 22.

Figure 6:
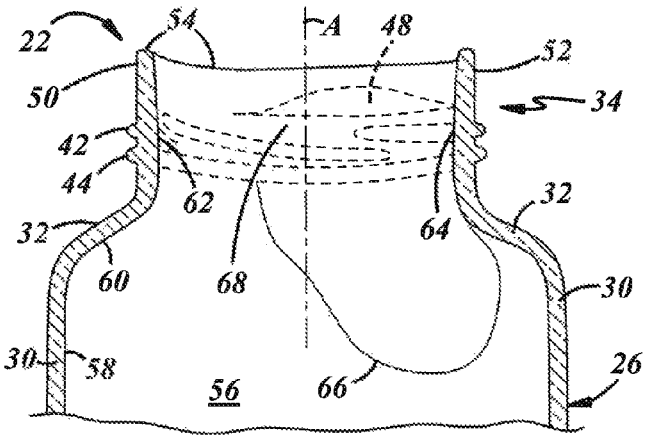
FIG. 6 is a fragmentary sectional view of the container of FIG. 1, taken substantially along line 6-6 of FIG. 5.
Figure 7:
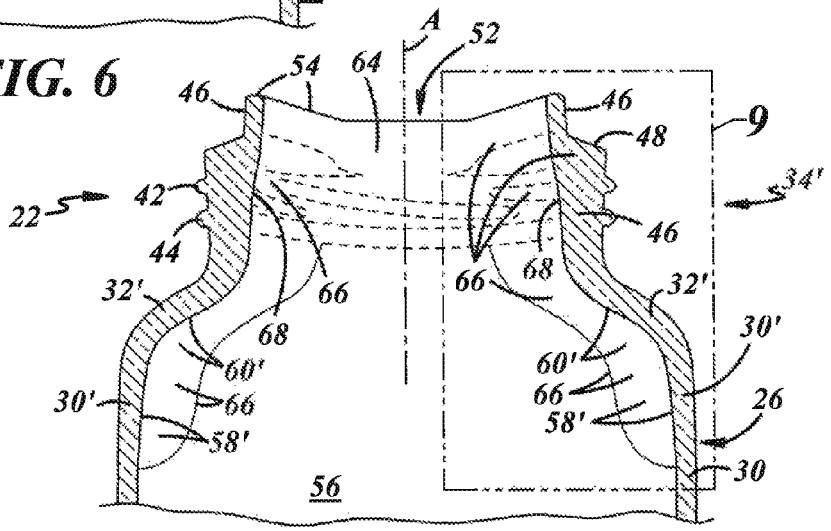
FIG. 7 is a fragmentary sectional view of the container of FIG. 1, taken substantially along line 7-7 of FIG. 5.
Figure 8:
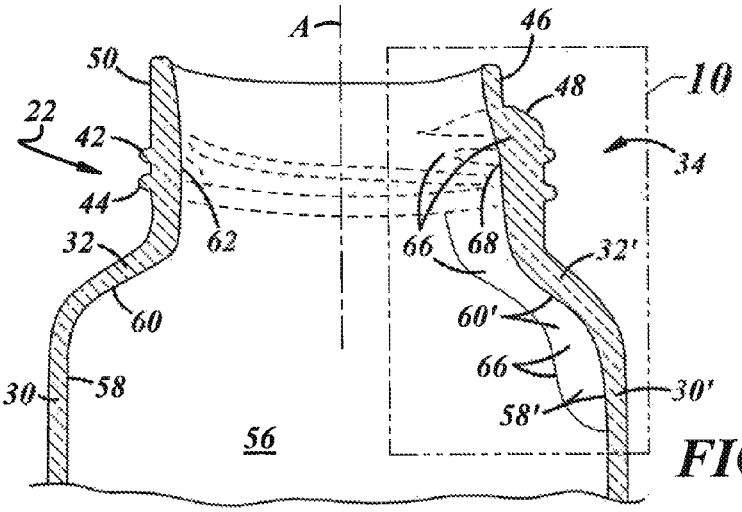
FIG. 8 is a fragmentary sectional view of the container of FIG. 1, taken substantially along line 8-8 of FIG. 5.
Figure 9:
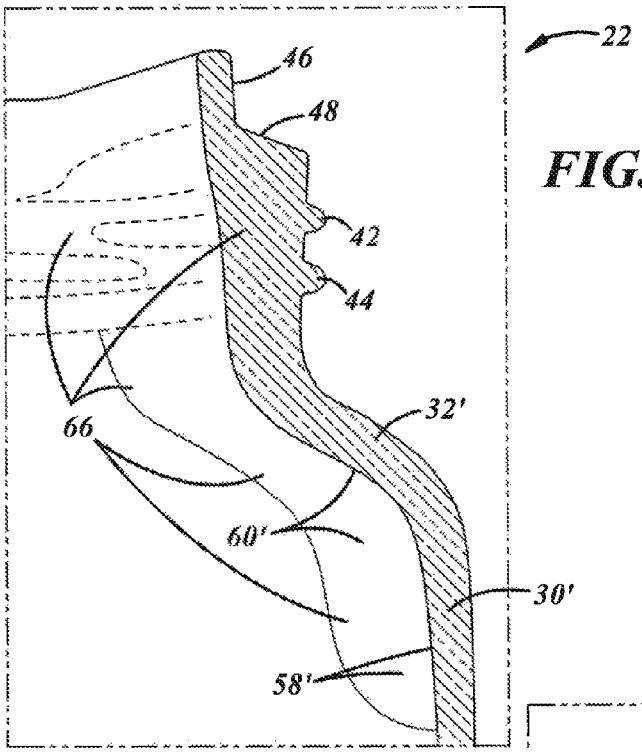
FIG. 9 is an enlarged fragmentary sectional view of a portion of the container of FIG. 1, taken from box 9 of FIG. 7.
Figure 10:
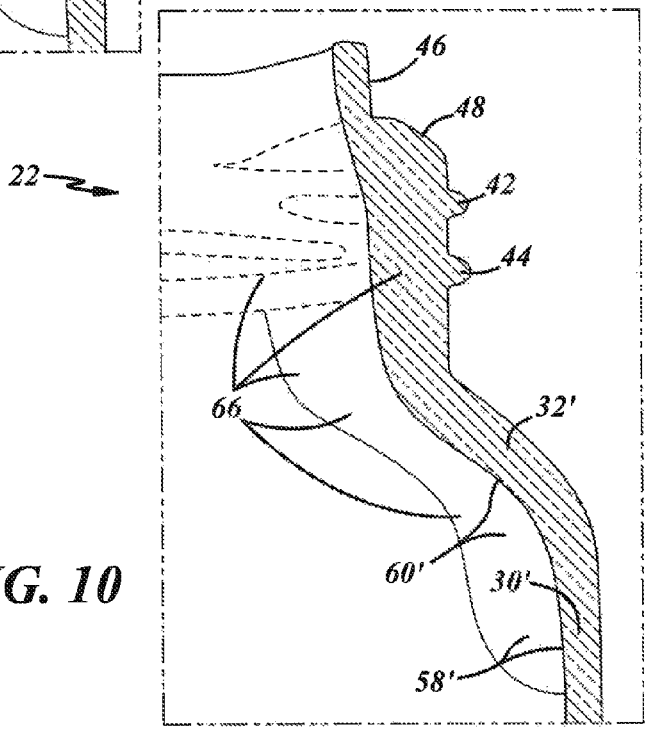
FIG. 10 is an enlarged fragmentary sectional view of a portion of the container of FIG. 1, taken from box 10 of FIG. 8.

Referring to FIG. 6, the container 22 may include an interior 56, a sidewall interior surface 58 of the body sidewall 30, a shoulder interior surface 60 of the body shoulder 32, a rear wall interior surface 62 of the neck finish 34 at a location corresponding to the rear wall 50, and a trough wall interior surface 64 of the neck finish 34 at a location corresponding to the trough wall 52. As shown in FIG. 6, an inside diameter between the rear and trough walls 50, 52, or an inside radius of the interior surface 62 of the neck finish 34, may be greatest at the sealing surface 54 and may be smallest at the lower portion 36 (FIG. 4). Also as shown in FIG. 6, the radial wall thickness of the neck finish 34 at locations corresponding to the rear and trough walls 50, 52 may be the same and may be symmetrical.

Referring to FIGS. 7-10, the container 22 also may include thickened wall portions 66. The thickened wall portions 66 may correspond with the spout walls 46 and may be circumferentially spaced apart. Also, the thickened wall portions 66 may form an internal trough to direct flow of product toward the pour spout between the spout walls 46. The thickened wall portions 66 may be disposed beneath the spout walls 46 or axially between the spout walls 46 and the base 28 of the container 22. Also, the thickened wall portions 66 may be circumferentially aligned with the spout walls 46. The thickened wall portions 66 may extend from the neck finish 34 to the shoulder 32, and may also extend to the sidewall 30.

The container 22 also includes interior surfaces 68 of the container neck finish 34 at locations corresponding to the spout walls 46. The thickened wall portions 66 may include those interior surfaces 68. In addition, the thickened wall portions 66 may form interior surfaces 58' of a thickened body sidewall portion 30' that are disposed radially inward of the interior surfaces 58 of the sidewall 30. The thickened wall portions 66 also may form interior surfaces 60' of a thickened body shoulder portion 32' that are disposed radially inward of the interior surfaces 60 of the shoulder 32. In any case, the thickened wall portions 66 extend radially inwardly, for example toward the axis A with respect to one or more of the interior surfaces 58, 60, 62, 64, to form an internal trough to direct flow of product toward the pour spout.

Figure 11:
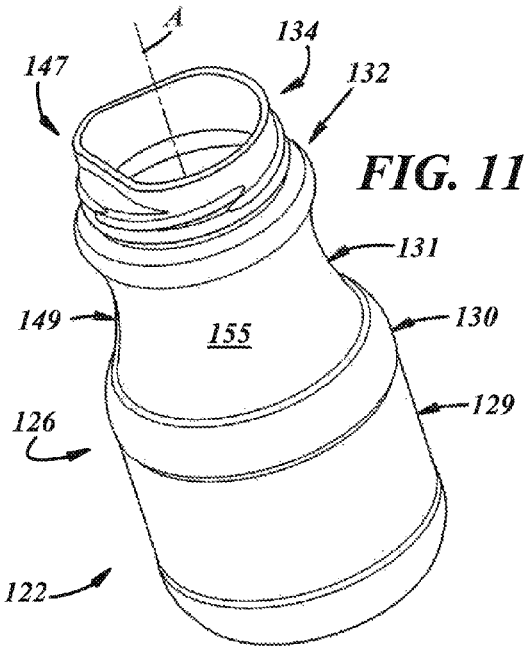
FIG. 11 is a perspective view of a container in accordance with another illustrative embodiment of the present disclosure.
Figure 13:
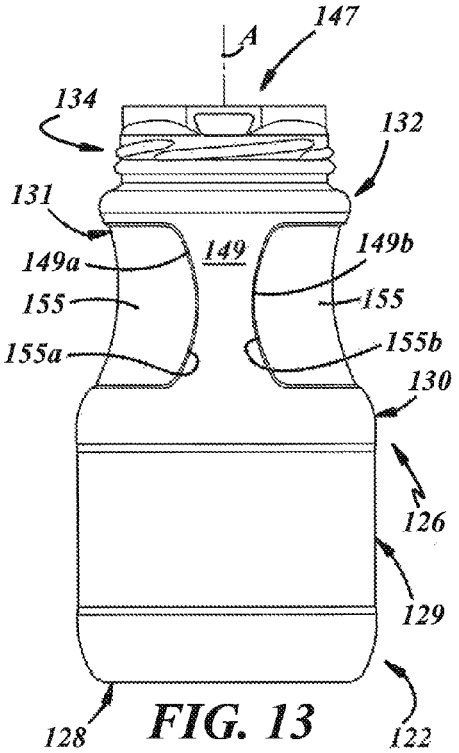
FIG. 13 is a front view of the container of FIG. 11.
Figure 12:
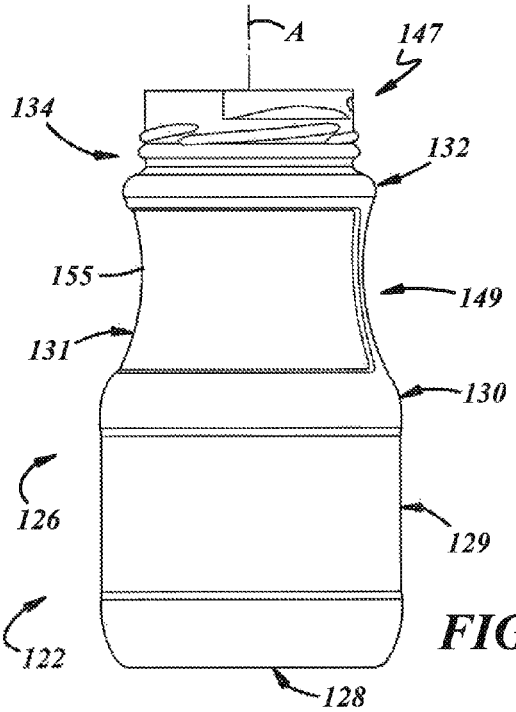
FIG. 12 is a side view of the container of FIG. 11.

FIGS. 11 through 13 illustrate another illustrative embodiment of a container 122. This embodiment is similar in many respects to the embodiments of FIGS. 1-10 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The container 122 includes a body 126 including a base 128, a sidewall 130 extending in a direction axially away from the base 128, and a shoulder 132. The container 122 also has a first longitudinal axis A, and includes a neck finish 134 extending from the shoulder 132 of the body 126. The neck finish 134 may be the same as that described above with respect to FIGS. 1-10 and, thus, may include a pour spout 147 and may accept the closure 24 illustrated in FIG. 1.

The sidewall 130 includes a spout indicator 149 circumferentially corresponding to the pour spout 147, for instance, to indicate to a user the location of the pour spout 147 when a closure (not shown) applied to the container 122 obscures the circumferential orientation of the pour spout 147. Accordingly, when using the container 122, a user first may see the spout indicator 149 and then grip the container 122 in a suitable location and manner to enable the user to remove the closure and pour contents from the container 122 without having to adjust the user=s grip to reorient the pour spout 147. The spout indicator 149 may be circumferentially aligned with the pour spout 147.

The spout indicator 149 may be provided in any suitable manner. For example, the spout indicator 149 may be formed from the same material as the rest of the sidewall 130. More specifically, the spout indicator 149 and the rest of the sidewall 130 may be formed of glass in a glass container manufacturing process. In other examples, the spout indicator 149 may be a separate component separately applied to the sidewall 130.

Referring to FIG. 13, the sidewall 130 may include a grip 155, for instance, to facilitate a good grip of the container 122 and further visually distinguish the spout indicator 149 so as to further enhance a user=s ability to quickly spot the spout indicator 149 and begin using the container 122. The grip 155 may extend circumferentially partially around the body 126, may be indented or radially recessed, and may have circumferential ends 155*a*, 155*b* that may define or establish corresponding circumferential portions 149*a*, 149*b* of the spout indicator 149. The circumferential ends 155*a*, 155*b* of the grip 155 may be excurvate in a circumferential direction and the corresponding ends 149*a*, 149*b* of the indicator 149 may be incurvate in a circumferential direction, or vice-versa, or the ends may be straight or of any other suitable shape.

In the embodiment of FIGS. 11-13, the sidewall 130 may include a first portion 129 extending axially from the base 128 and a second portion 131 extending axially between the first portion 129 and the neck finish 134, wherein the second portion 131 may include the spout indicator 149 and the grip 155. The shoulder 132 may extend between the grip 155 and the neck finish 134. Also, the first portion 129 may have a cylindrical outer surface that may be recessed as shown, for instance, to accept a product label, whereas the second portion 131 may have an outer surface that is incurvate in a radial direction, for instance for good gripping by a user.

FIGS. 14 through 17 illustrate another illustrative embodiment of a container 222. This embodiment is similar in many respects to the embodiments of FIGS. 1-13 and like numerals between the embodiments generally designate like or corresponding elements throughout the several views of the drawing figures. Accordingly, the descriptions of the embodiments are incorporated into one another. Additionally, the description of the common subject matter generally may not be repeated here.

Figure 14:
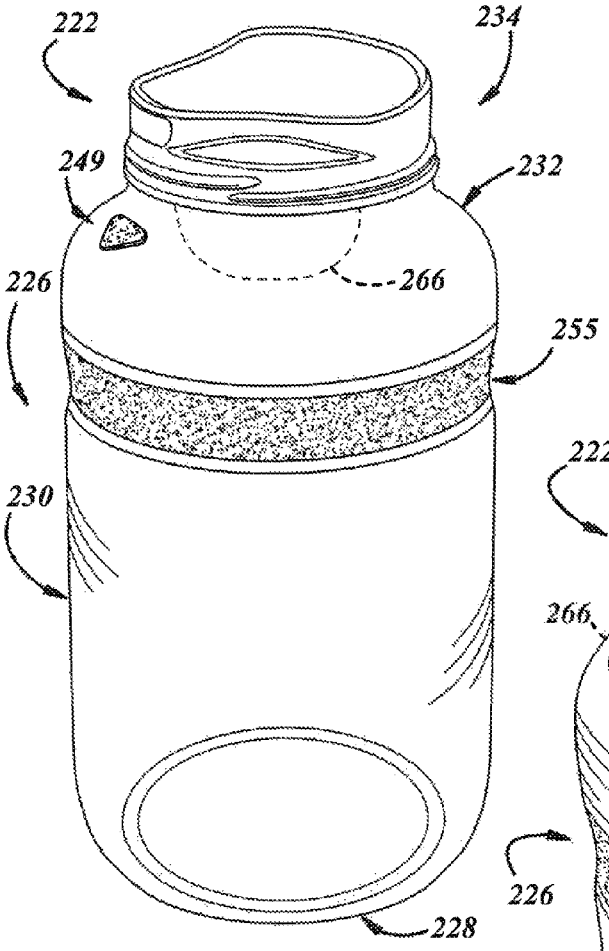
FIG. 14 is a side perspective view of a container in accordance with a further illustrative embodiment of the present disclosure.
Figure 15:
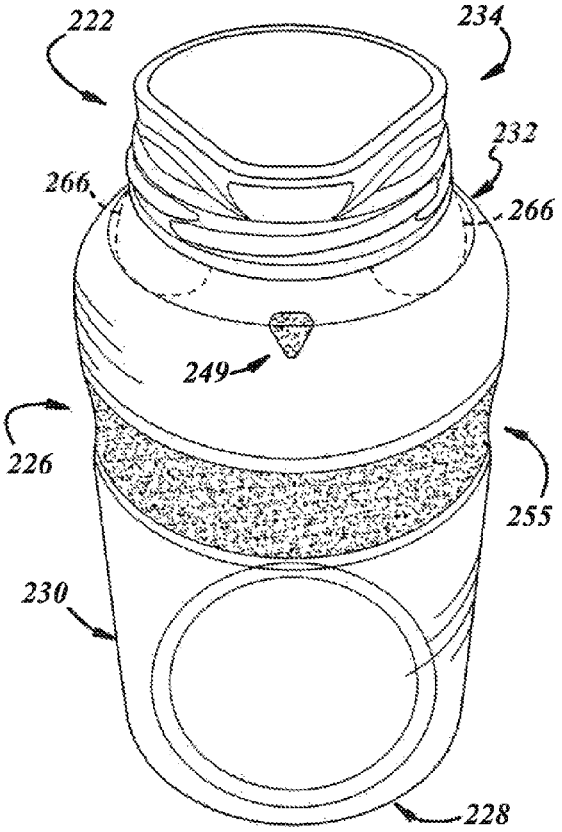
FIG. 15 is a front perspective view of the container of FIG. 14.

With reference to FIGS. 14 and 15, the container 222 includes a body 226 including a base 228, a sidewall 230 extending from the base 228, and a shoulder 232 extending from the sidewall 230, as illustrated in the Figures. The container 222 also may include a neck finish 234 extending from the shoulder 232 of the sidewall 230 of the body 226.

The sidewall 230 may include a spout indicator 249 circumferentially corresponding to the pour spout 247. For example, as best shown in FIG. 15, the spout indicator 249 may be circumferentially aligned with the pour spout 247. Also, the spout indicator 249 may be provided on the shoulder 232. The spout indicator 249 may be generally triangular, for instance, with radiused vertices, as illustrated. The spout indicator 249 may be of the same smooth surface finish as the rest of the body 226 or, as shown, may be textured to provide a surface finish that is coarser than rest of the body 226.

The sidewall 230 also may include a circumferentially extending grip 255. The grip 255 may extend continuously, circumferentially, entirely around the container 222 and may be radially recessed. The grip 255 may be of the same smooth surface finish as the rest of the body 226 or, as shown, may be textured to provide a surface finish that is coarser than rest of the body 226. The grip 255 may be a relatively narrow band, for example, having a width or height less than one-quarter of the height of the body 226. In a more particular example, the height of the grip 255 may be less than one-inch.

As shown in FIGS. 14 and 15, the grip 255 may be bordered by transitions between the outer surface of the sidewall 230 and the grip 255. The shape of the transitions may correspond to the shape of the grip 255 itself. The texture of the transitions may be the same as that of the sidewall 230 in general.

Figure 16:
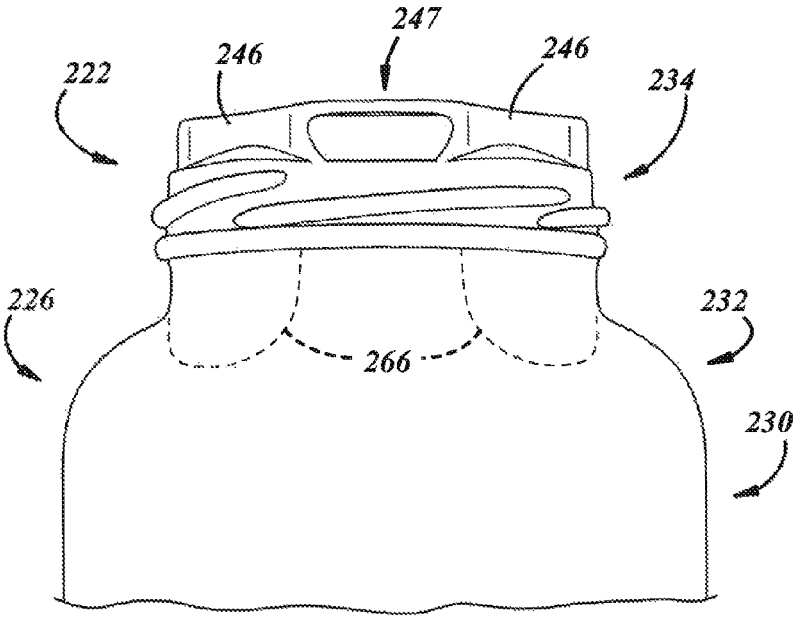
FIG. 16 is an enlarged fragmentary front view of the container of FIG. 14.
Figure 17:
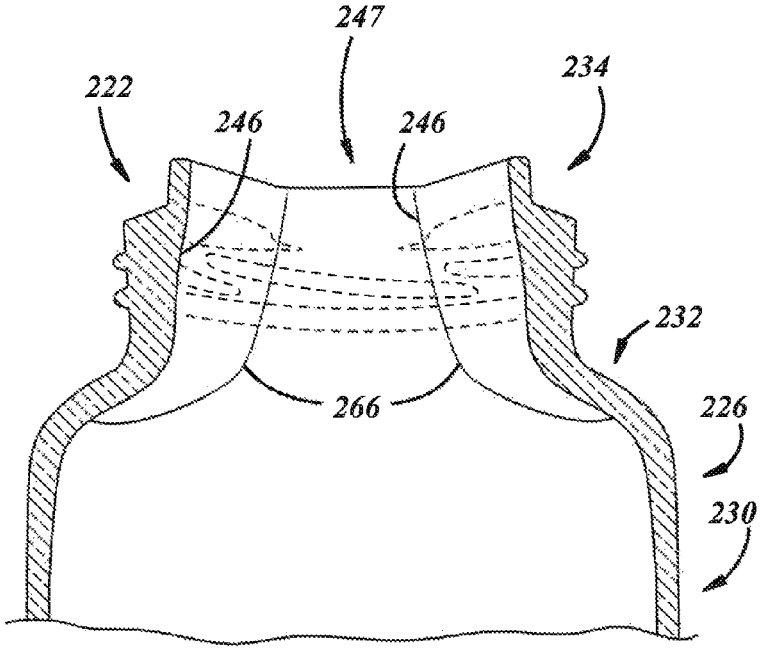
FIG. 17 is a fragmentary sectional view of the container of FIG. 14.

With reference also to FIGS. 16 and 17, the container 222 also may include thickened wall portions 266. The thickened wall portions 266 may correspond with spout walls 246 and may be circumferentially spaced apart to form an internal trough to direct flow of product toward the pour spout 247 between spout walls 246. The thickened wall portions 266 are similar to those described and shown in the previous embodiments, however, they may extend from the spout walls 246 into the neck finish 234 but do not extend below the shoulder 232 down along the sidewall 230 of the body 226. Otherwise, the thickened wall portions 266 may be identical to the previously described thickened wall portions 266.

FIGS. 18 through 21 illustrate another illustrative embodiment of a container 322. This embodiment is similar in many respects to the embodiments of FIGS. 1-17 and like numerals between the embodiments generally designate like or corresponding elements throughout the several views of the drawing figures. Accordingly, the descriptions of the embodiments are incorporated into one another. Additionally, the description of the common subject matter generally may not be repeated here.

Figure 18:
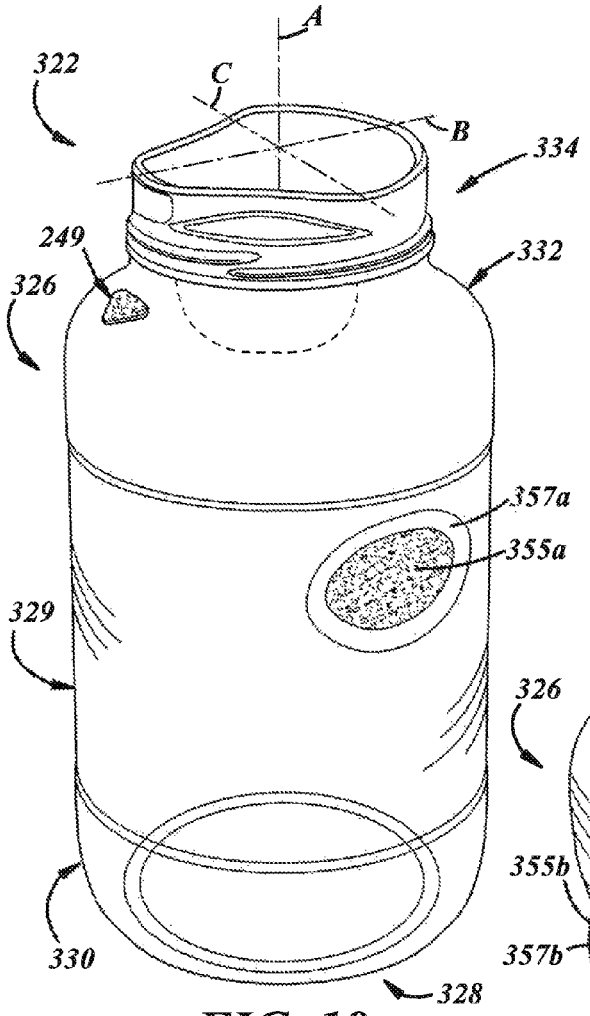
FIG. 18 is a side perspective view of a container in accordance with an additional illustrative embodiment of the present disclosure.
Figure 19:
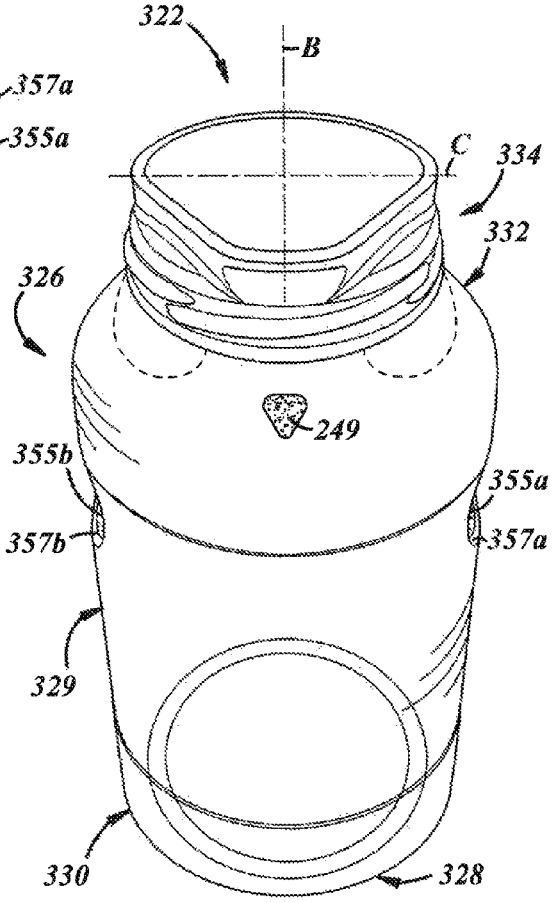
FIG. 19 is a front perspective view of the container of FIG. 18.

With reference to FIGS. 18 and 19, the container 322 includes a body 326 including a base 328, a sidewall 330 extending from the base 328, and a shoulder 332 extending from the sidewall 330, as illustrated in the Figures. The container 322 also includes a neck finish 334 extending from the shoulder 332 of the sidewall 330 of the body 326. The sidewall 330 may include the spout indicator 249 described above with respect to FIGS. 14-17.

Figure 20:
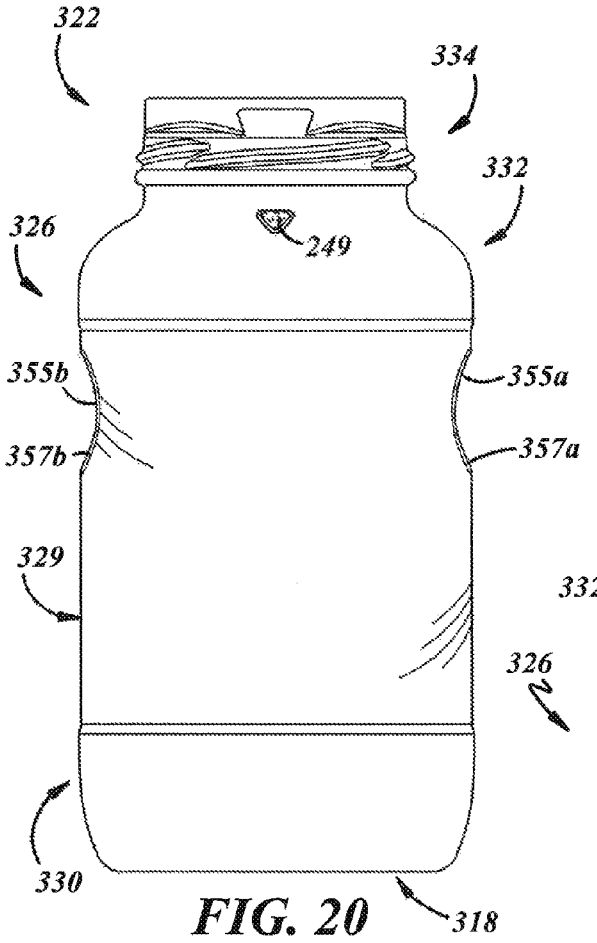
FIG. 20 is a front view of the container of FIG. 18.
Figure 21:
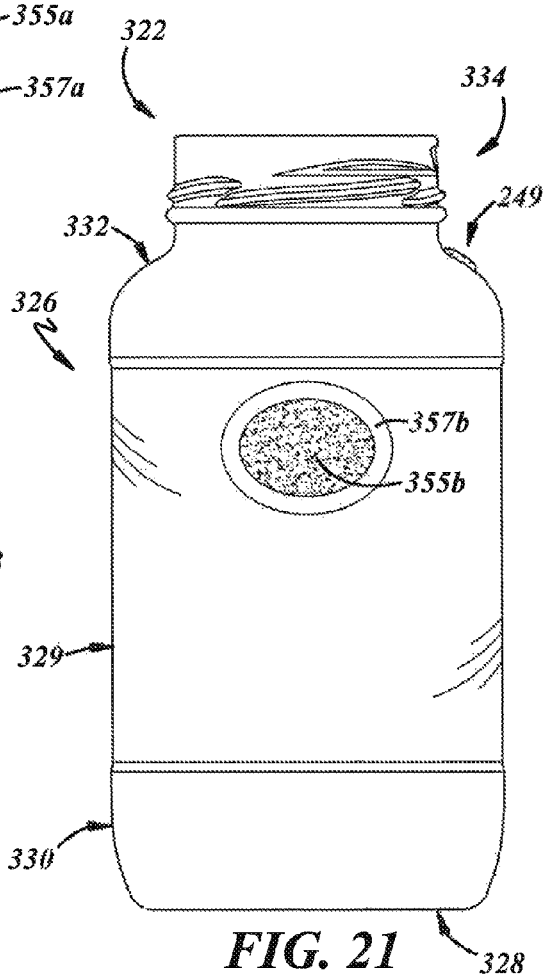
FIG. 21 is a side view of the container of FIG. 18.

Also, the sidewall 330 may include a grip, which may include multiple grip portions, for example, two discrete or individual grip portions 355*a*, 355*b*. The grip portions 355*a*, 355*b* may be disposed on opposite sides of the container body 326, for instance, diametrically opposed from one another on either side of radial axis B as best shown in FIGS. 19 and 20. The grip portions 355*a*, 355*b* may be of the same smooth surface finish as the rest of the body 326 or, as shown, may be textured to provide a surface finish that is coarser than rest of the body 326. The grip portions 355*a*, 355*b* may be generally oval-shaped, for instance, egg-shaped, ellipse-shaped, oblong, or the like, and/or may correspond to an index finger placement and a thumb placement. The grip portions 355*a*, 355*b* may be bordered by transitions 357*a*, 357*b* between the outer surface of the sidewall 330 and the grip portions 355*a*, 355*b*. The shape of the transitions 357*a*, 357*b* may correspond to the shape of the grip portions 355*a*, 355*b*. The texture of the transitions 357*a*, 357*b* may be the same as that of the sidewall 330 in general.

The sidewall 330 may have an outer surface portion 329 that may be recessed as shown, for instance, to accept a product label. The grip portions 355*a*, 355*b* may be provided in the recessed portion 329.

FIGS. 22 through 26 illustrate another illustrative embodiment of a container 422. This embodiment is similar in many respects to the embodiments of FIGS. 1-21 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The container 422 may be produced by a method disclosed in U.S. patent application Ser. No. 13/709,288, filed on Dec. 10, 2012, assigned to the assignee hereof, and hereby incorporated herein by reference in its entirety.

Figure 22:
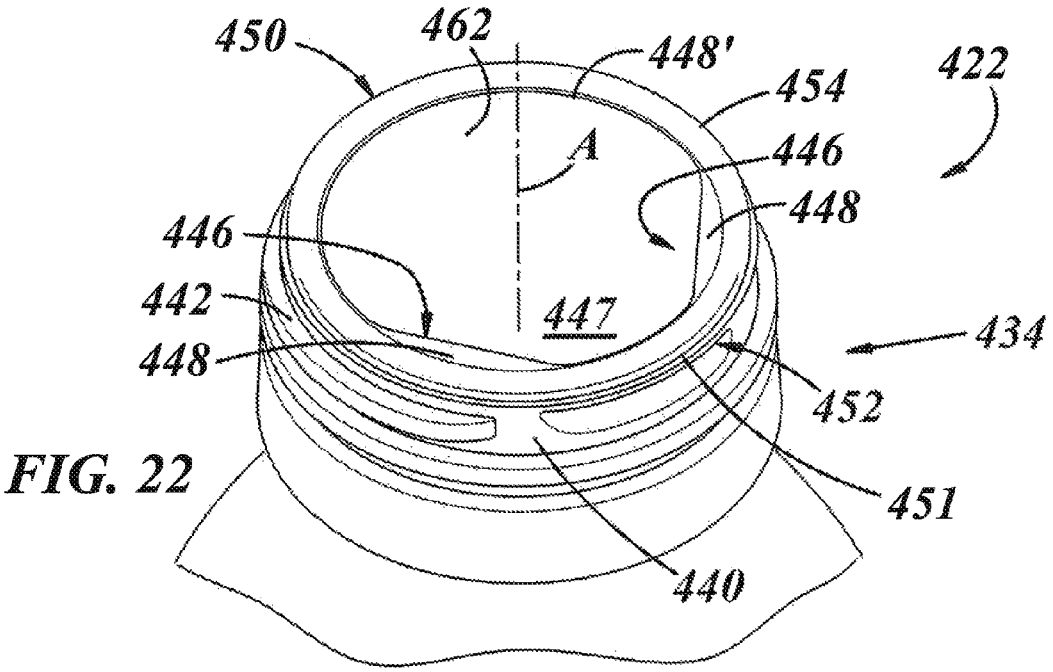
FIG. 22 is a fragmentary perspective view of a container in accordance with an additional illustrative embodiment of the present disclosure.
Figure 23:
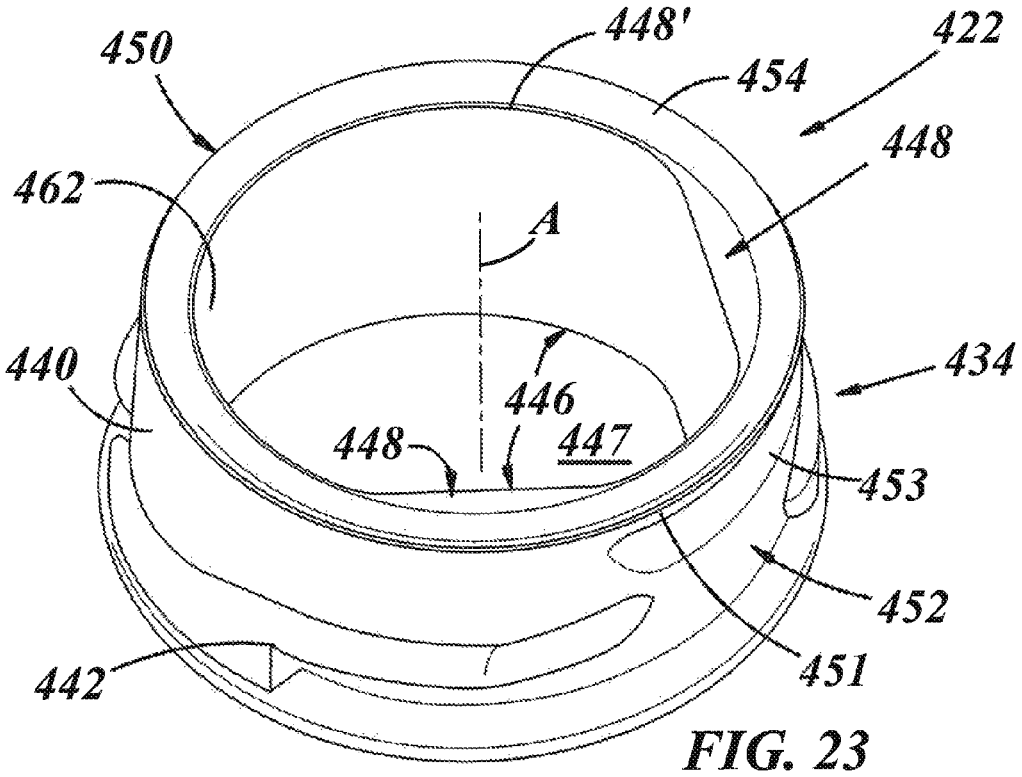
FIG. 23 is an enlarged fragmentary perspective view of the container of FIG. 22.

With respect to FIGS. 22 and 23, the container 422 includes a neck finish 434 having a generally cylindrical exterior and a generally non-cylindrical interior. The cylindrical exterior of the neck finish 434 includes an outer surface 440 and one or more closure engagement features 442, or any other suitable features, on the outer surface 440. The neck finish 434 also may include a rear wall 450 of semi-circular or semi-cylindrical shape, and a trough wall 452 disposed on an opposite side from the rear wall 450 and that also may be of semi-circular or semi-cylindrical shape. The rear and trough walls 450, 452 may be coaxial and coincident so as to be on a common circle. The common circle may include a neck finish sealing lip that may establish a circular, planar sealing surface 454. The trough wall 452 may include a radially outwardly extending lip or projection 451 and a radially recessed portion 453, for example, to aid in pouring contents from the container 422 in a clean or anti-drip manner.

The non-cylindrical interior of the neck finish 434 includes a rear wall interior surface 462 of the neck finish 434 at a location corresponding to the rear wall 450, and a trough wall interior surface 464 (FIG. 25) of the neck finish 434 at a location corresponding to the trough wall 452. The radial wall thickness of the neck finish 434 at locations corresponding to the rear and trough walls 450, 452 may be the same and may be symmetrical. The interior surfaces 462, 464 may be circular, concentric and coaxial with the outer surface 440 of the neck finish 434. Accordingly, portions of the non-cylindrical interior of the neck finish 434 may themselves be circular or cylindrical. But as will be described below, other portions of the interior of the neck finish 434 render the neck finish interior generally non-cylindrical.

For example, the non-cylindrical interior of the container neck finish 434 also may include spout walls 446 (or thickened wall portions 466 per FIG. 26) disposed radially inwardly with respect to the sealing lip 454 and with respect to the rear and trough walls 450, 452 and laterally opposed from one another on either side of the trough wall 452, distal with respect to the rear wall 450. The trough wall 452 may be disposed between forward ends of the thickened wall portions 446 and the rear wall 450 may be disposed between rearward ends of the thickened wall portions 446. The spout walls 446 alone or together with the trough wall 452 may form a pour spout 447. The spout walls 446 may be indents, embossments, or thickened wall portions 466 (e.g., FIG. 26). The spout walls 446 may extend chordally and may be generally straight as shown but, in other embodiments, the walls 446 may be incurvate, excurvate, or of any other suitable shape. In any case, the spout walls 446 have a radial wall thickness greater than that of the rear and trough walls 450, 452.

The spout walls 446 may include shoulders 448 disposed between the longitudinal central axis A of the container 422 and the lip sealing surface 454. The shoulders 448 may include generally axially facing surfaces that extend transversely with respect to the axis A.

In a first example, the shoulders 448 may be disposed in a plane perpendicular to the central axis A. In this example, the shoulders 448 may be coplanar with a step-down 448' extending circumferentially between the shoulders 448 such that a circumferentially continuous step-down surface may be established by the shoulders 448 and the step-down 448'.

Figure 23A:
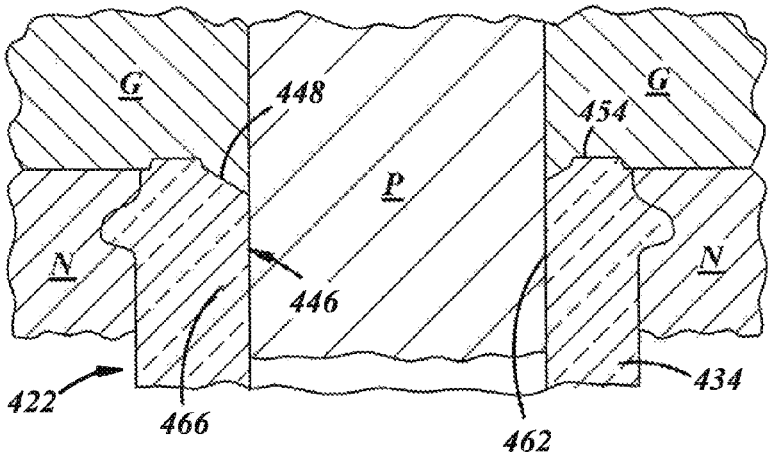
FIG. 23A is a schematic sectional view of a blank mold to produce the container of FIG. 22.
Figure 24:
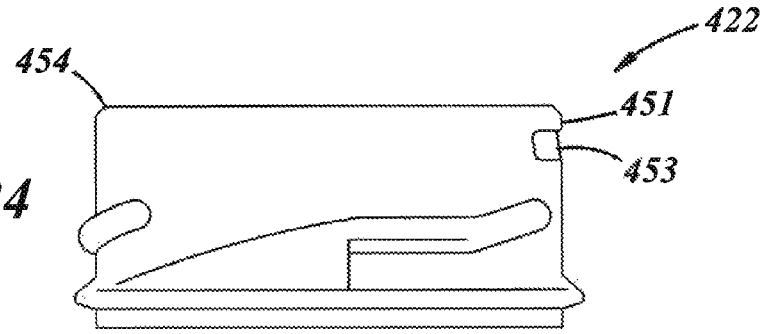
FIG. 24 is a fragmentary, elevational side view of the container of FIG. 22.
Figure 25:
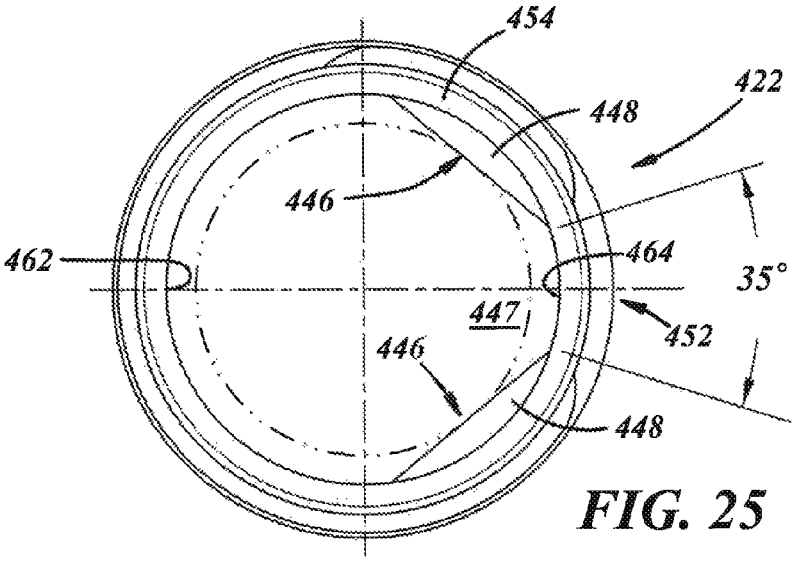
FIG. 25 is a fragmentary, top view of the container of FIG. 22.

As illustrated in FIG. 23A, the shoulders 448 may be produced in a blank mold by corresponding surfaces of a neck finish guide ring G. The mold may include a neck ring N to at least partially establish an exterior portion of the neck finish 434 of the container 422, a plunger P to at least partially establish an interior portion of the neck finish 434 including the spout walls 446 (thickened wall portions 466), and interior surfaces (e.g., interior surface 462), and the guide ring G that may establish the shoulders 448, sealing surface 454, and the like.

Figure 27:
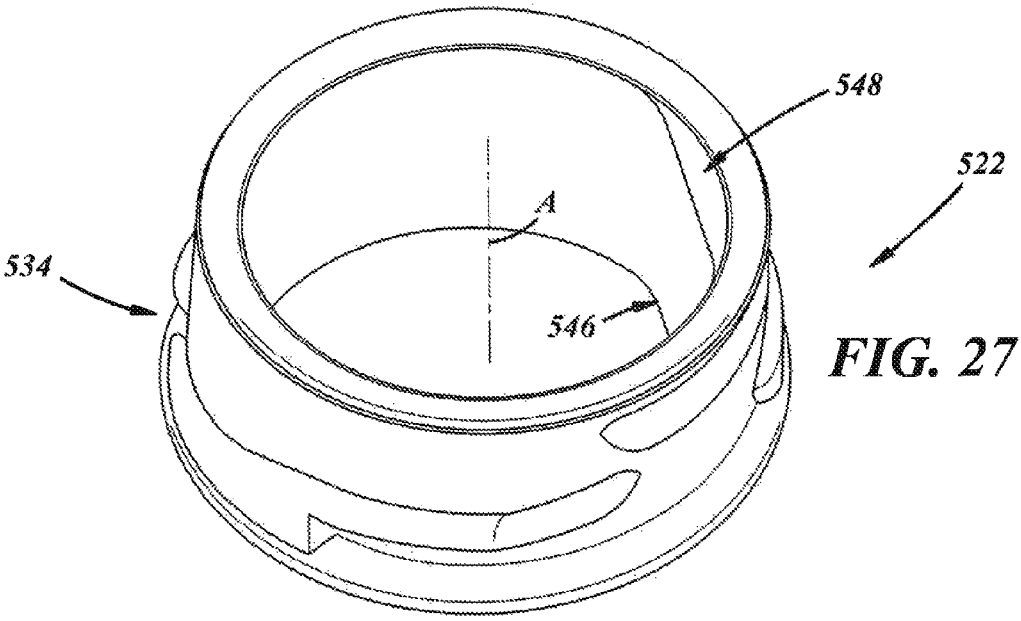
FIG. 27 is a fragmentary perspective view of a container in accordance with a further illustrative embodiment of the present disclosure.

In a second example, and with reference to FIG. 27, shoulders 548 (one shown) may be disposed at a non-perpendicular angle with respect to a longitudinal central axis A, extending in a direction axially inwardly into a container 522 and radially inwardly toward the longitudinal central axis of the container 522. In this illustrated example, no additional step-down may be provided. But other embodiments may include both the angled shoulders 548 and a step-down extending circumferentially therebetween.

Figure 27A:
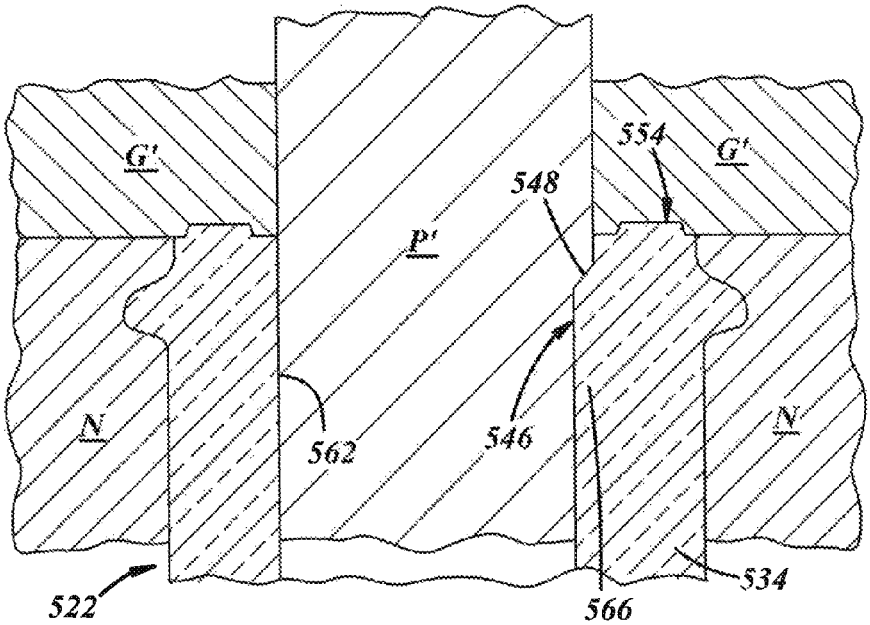
FIG. 27A is a schematic sectional view of a blank mold to produce the container of FIG. 27.

With reference to FIG. 27A, both the shoulders 548 and spout walls 546 (e.g., thickened wall portions 566) may be produced in a blank mold by corresponding surfaces of a plunger P'. The mold may include a neck ring N to at least partially establish an exterior portion of the neck finish 534 of the container 522, the plunger P to at least partially establish an interior portion of the neck finish 534 including the spout walls 546/thickened wall portions 566, and interior surfaces (e.g., interior surface 562), and a guide ring G' that may establish the sealing surface 554, and the like.

The embodiment of FIGS. 27 and 27A is similar in many respects to the embodiments of FIGS. 1-29 and like numerals between the embodiments generally designate like or corresponding elements throughout the several views of the drawing figures. Accordingly, the descriptions of the embodiments are incorporated into one another, and the description of the common subject matter generally may not be repeated here.

Referring again to FIGS. 23, 23A, 27, and 27A, the shoulders 448, 548 are axially spaced from, or axially recessed with respect to, the planar sealing surface 454, 554. In fact, the shoulders 448, 548 may be recessed an amount greater than would be provided for a conventional step-down of a conventional container. For instance, the step-down 448' may be axially recessed from the sealing surface 454 at least 0.020" and over 1 mm for a 35 mm finish.

Figure 26:
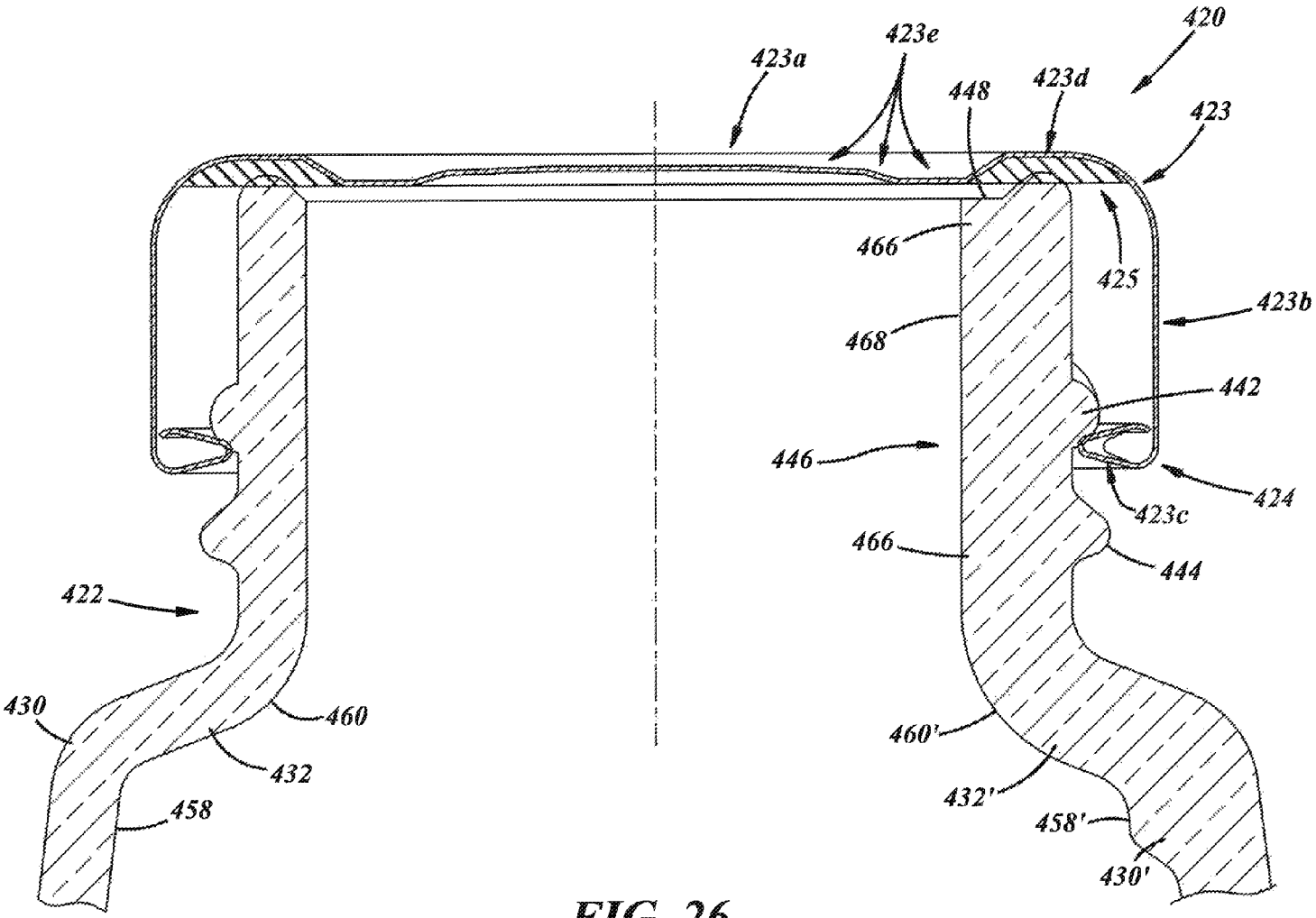
FIG. 26 is a fragmentary cross-sectional view of a package including the container of FIG. 22 and a closure coupled thereto.

To illustrate, with reference to FIG. 26, a package 420 includes the container 422 and a seal carrying closure 424 sealingly coupled to the container 422. The closure 424 includes a lid 423 carrying a seal 425. The lid 423 may include a base wall 423*a*, a skirt 423*b* extending axially from the base wall 423*a* and including one or more container engagement features 423*c* for coupling to the corresponding features 442 of the container 422. The base wall 423*a* may include one or more peripheral panels 423*d* radially adjacent and extending radially inwardly from the skirt 423*b*, and one or more central panels 423*e* extending radially inwardly from the peripheral panel(s) 423*d* and recessed or extending axially inwardly from the panel(s) 423*d*. The seal 425 may be carried by the peripheral panel(s) 423*d* and generally radially between the skirt 423*b* and the central panel(s) 423*e*.

The shoulders 448 (and 548) may be recessed to such an extent that when the closure 424 is fully coupled to the container 422, as illustrated in FIG. 26, there is axial clearance between the shoulders 448 and the central panel 423*e* and, more specifically, there may be axial clearance between the shoulders 448 and the seal 425. Accordingly, there may be no interference between the shoulders 448 and the lid 423 and/or the seal 425. In the illustrated example, the lid 423 may be composed of a metallic material and the seal 425 may be composed of a polymeric material. In other examples, the lid 423 and the seal 425 may be composed of any suitable materials.

With continuing reference to FIG. 26, the thickened wall portions 466 may extend from the shoulders 448 axially into the container 422, past the engagement feature(s) 442 and/or flange 444. For example, the portions 466 may extend to a shoulder 432 of the container 422 to establish a thickened shoulder portion 432'. In another example, the portions 466 may further extend axially to a sidewall 430 of the container 422 to establish a thickened sidewall portion 430'. Accordingly, the spout walls 446 or thickened wall portions 466 may include interior surfaces 468 of the container neck finish 434, interior surfaces 460' of the thickened shoulder portion 432', and interior surfaces 458' of the thickened sidewall portion 430', at least at locations corresponding to and axially beneath the shoulders 448. In any case, the thickened wall portions 466 extend radially inwardly toward the central axis A with respect to one or more of the interior surfaces 462, 464 of the rear and/or trough walls 450, 452 to form an internal trough of desired axial length to direct flow of product out of the container 422.

There thus has been disclosed containers that may provide improved product flow and that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A container that includes:

a body including a base and a sidewall extending from the base;

a neck finish extending from the body and including:

a neck finish interior surface facing radially inwardly and including one or more circular portions, and a sealing lip facing generally axially and fully circumferentially continuously around the neck finish interior surface; and at least two thickened wall portions circumferentially spaced apart and extending radially inwardly and chordally with respect to the neck finish, and including:

interior surfaces disposed radially inwardly of the neck finish interior surface to at least partially establish an internal trough, and axially facing shoulders axially recessed with respect to the lip of the neck finish;

wherein the neck finish also includes a fully circumferentially continuously extending step-down axially recessed with respect to the sealing lip and coplanar with the shoulders.

2. The container set forth in claim 1 wherein the body includes an interior, the sidewall includes a sidewall interior surface, and the interior surfaces of the thickened wall portions extend chordally with respect to the neck finish.

3. The container set forth in claim 1 wherein the body also includes a shoulder between the sidewall and the neck finish, and the thickened wall portions extend from the neck finish to the shoulder.

4. The container set forth in claim 1 wherein the thickened wall portions extend from the neck finish to the sidewall.

5. The container set forth in claim 1 wherein the one or more circular portions of the neck finish include a semi-circular trough wall disposed between forward ends of the thickened wall portions and an oppositely disposed semi-circular rear wall disposed between rearward ends of the thickened wall portions.

6. The container set forth in claim 5 wherein the rear and trough walls are on a common circle and have interior surfaces concentric with an outer surface of the neck finish.

7. The container set forth in claim 1 wherein the shoulders are disposed in a plane perpendicular to a longitudinal central axis of the container.

8. The container set forth in claim 1 wherein the shoulders are disposed at a non-perpendicular angle with respect to a longitudinal central axis of the container and extend in a direction axially inwardly into the container and radially inwardly toward the axis.

9. The container set forth in claim 1 wherein the step-down is axially recessed greater than 0.020".

10. A package including the container of claim 1 and a closure coupled thereto.

11. A package that includes:

a container including:

a neck finish having:

a neck finish sealing lip to establish a circular planar sealing surface extending fully circumferentially continuously around an interior surface of the neck finish, circumferentially spaced spout walls disposed radially inwardly and having interior surfaces extending chordally with respect to the sealing lip to form an internal trough, and having axially facing shoulders axially recessed with respect to the sealing lip; and a closure coupled to the container, and including:

a lid having a base wall and a peripheral skirt extending axially from the base wall, and a seal carried by the lid, wherein an axial clearance exists between the lid base wall and the axially facing shoulders of the spout walls.

12. The package set forth in claim 11 wherein the lid base wall includes at least one peripheral panel extending radially inwardly from the peripheral skirt and at least one central panel extending radially inwardly from the peripheral skirt and axially inwardly, and the seal is carried by the at least one peripheral panel and engages the sealing lip but not the spout wall shoulders.

13. A container that includes:

a neck finish having:

an interior surface, an outer surface, one or more closure engagement features on the outer surface, a semi-circular rear wall having a rear interior surface, a semi-circular trough wall disposed on an opposite side from the rear wall and coaxial with the rear wall and having a trough interior surface, a neck finish sealing lip to establish a circular planar sealing surface extending fully circumferentially continuously around the neck finish interior surface, and circumferentially spaced spout walls disposed radially inwardly with respect to the sealing lip and laterally opposed from one another on either side of the trough wall to form an internal trough, distal with respect to the rear wall, said spout walls having interior surfaces extending chordally between the rear and trough walls and having radial wall thicknesses greater than that of the rear and trough walls and having axially facing shoulders axially recessed with respect to the sealing lip.

14. A package that includes:

the container of claim 13; and a closure coupled to the container, and including:

a lid having a base wall and a peripheral skirt extending axially from the base wall and including at least one container engagement feature coupled to the one or more closure engagement features of the container, and a seal carried by the lid, wherein an axial clearance exists between the lid base wall and the axially facing shoulders of the spout walls.

15. The package set forth in claim 14 wherein the lid base wall includes at least one peripheral panel extending radially inwardly from the peripheral skirt and at least one central panel extending radially inwardly from the peripheral skirt and axially inwardly, and the seal is carried by the at least one peripheral panel and engages the sealing lip but not the spout wall shoulders.

16. The container set forth in claim 1 wherein the interior surfaces of the chordally-extending thickened wall portions are straight.

17. The package set forth in claim 11 wherein the interior surfaces of the chordally-extending spout walls are straight.

18. The container set forth in claim 13 wherein the interior surfaces of the chordally-extending spout walls are straight.

19. A container that includes:

a body including a base and a sidewall extending from the base; a shoulder extending from the sidewall; a neck finish extending from the shoulder and including:

a neck finish interior surface facing radially inwardly and including one or more circular portions, and a sealing lip facing generally axially and fully circumferentially continuously around the neck finish interior surface; and at least two thickened wall portions circumferentially spaced apart, extending radially inwardly, and extending axially from the neck finish to the shoulder such that at least portion of each of the thickened wall portions axially overlaps at least a portion of the shoulder, and including:

interior surfaces disposed radially inwardly of the neck finish interior surface to at least partially establish an internal trough, and axially facing shoulders axially recessed with respect to the lip of the neck finish;

wherein the neck finish also includes a fully circumferentially continuously extending step-down axially recessed with respect to the sealing lip and coplanar with the shoulders.

20. A container, comprising:

a neck finish having:

an interior surface, an outer surface, a semi-circular rear wall having a rear interior surface, a sealing lip fully circumferentially continuously around the neck finish interior surface, and a pour spout including:

a semi-circular trough wall disposed on an opposite side from the rear wall, and at least two spout walls circumferentially spaced apart and laterally opposed from one another on either side of the trough wall, and having thickened wall portions with radial wall thicknesses greater than that of the rear and trough walls and interior surfaces disposed radially inwardly of the interior surfaces of the rear and trough walls to form an internal trough; a body; and a shoulder between the neck finish and the body, wherein the thickened wall portions extend from the neck finish to the shoulder to at least partially establish an internal trough to direct flow of product out of the container, wherein the neck finish also includes a fully circumferentially continuously extending step-down axially recessed with respect to the sealing lip and coplanar with the shoulders.

21. The container set forth in claim 20, wherein the rear wall includes a rear interior surface, and the trough wall includes a trough interior surface coaxial with the rear interior surface and with the outer surface.

22. The container set forth in claim 20, wherein the sealing lip is circular.

23. The container set forth in claim 20, wherein the sealing lip is non-circular.

24. The container set forth in claim 1, wherein the sealing lip is circular.

25. The container set forth in claim 1, wherein the sealing lip is non-circular.

* * * * *